United States Patent [19]

Suzuki et al.

[11] 4,208,844

[45] Jun. 24, 1980

[54] GUARD DEVICE WITH DRESSING APPARATUS FOR GRINDING WHEEL

[75] Inventors: Yoshinobu Suzuki, Aichi; Toshio Maruyama, Kariya, both of Japan

[73] Assignee: Toyoda Koki Kabushiki Kaisha, Aichi, Japan

[21] Appl. No.: 15,241

[22] Filed: Feb. 26, 1979

[30] Foreign Application Priority Data

Feb. 27, 1978 [JP] Japan ..... 53-21942

[51] Int. Cl.[2] ..... B24B 55/04

[52] U.S. Cl. ..... 51/268; 125/11 DF

[58] Field of Search ..... 125/11 R, 11 DF; 51/268, 267

[56] References Cited

U.S. PATENT DOCUMENTS

| | | | |
|---|---|---|---|
| 3,667,445 | 6/1972 | Ota | 125/11 DF |
| 3,835,595 | 9/1974 | Oshima | 51/268 |
| 4,024,674 | 5/1977 | Suzuki | 51/268 |

*Primary Examiner*—Harold D. Whitehead

*Attorney, Agent, or Firm*—Oblon, Fisher, Spivak, McClelland & Maier

[57] ABSTRACT

A guard device with a dressing apparatus for a grinding wheel. A front cover member is pivotably supported on a guard body by a hinge shaft. A pair of leg portions are extended from the lower end of the front cover member and carry a pair of dressing tools for dressing the side surfaces of the grinding wheel. A front cover member is swung by the operation of a thread mechanism.

8 Claims, 6 Drawing Figures

GUARD DEVICE WITH DRESSING APPARATUS FOR GRINDING WHEEL

BACKGROUND OF THE INVENTION

1. Field of the Invention

The present invention relates generally to a guard device for a grinding wheel in a grinding machine, and more particularly to a guard device provided with a dressing apparatus for dressing side surfaces of the grinding wheel.

2. Description of the Prior Art

In a grinding machine for grinding crank-pin portions of a crankshaft for automobiles, it is necessary to dress both side surfaces of a fresh grinding wheel having been exchanged. For this purpose, a dressing apparatus has been detachably fixed upon a slide table for dressing operations. However, according to this arrangement, the dressing apparatus has to be detached from the table prior to grinding operations on workpieces to be ground in order to prevent interference thereof with other machine parts during the grinding operations so that the preparatory set up for the dressing operation is troublesome.

A conventional swingable front cover member is supported on the guard device for covering the upper-front portion of the grinding wheel. This front cover member has no dressing function, but only covers the grinding wheel.

SUMMARY OF THE INVENTION

It is therefore an object of the present invention to provide a new and improved guard device having an apparatus for dressing the side surfaces of a grinding wheel.

Another object of the present invention is to provide a new and improved guard device with a dressing apparatus wherein a pair of dressing tools are supported by a pivotable front cover member.

Briefly, according to the present invention, these and other objects are achieved by providing a guard device for a grinding wheel in a grinding machine, as mentioned above. A front cover member is pivotably mounted upon a guard body for covering the upper-front portion of the grinding wheel. A hinge shaft is carried in a direction parallel to the axis of the grinding wheel for pivotably supporting the front cover member. A screw shaft is rotatably supported upon the guard body above the hinge shaft in a direction perpendicular to the axis of the hinge shaft. A nut member is threadedly engaged with the screw shaft for pivotably moving the front cover member through the axial movement thereof caused by the rotation of the screw shaft. Means is mounted upon the guard body for rotating the screw shaft. A pair of leg portions are extended from the lower end of the front cover member to be receivable the grinding wheel within a space formed therebetween. A closing cover is detachably secured to the front cover member for covering the space formed between the pair of leg portions. A pair of dressing tools are respectively mounted upon the pair of leg portions for dressing the side surfaces of the grinding wheel.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
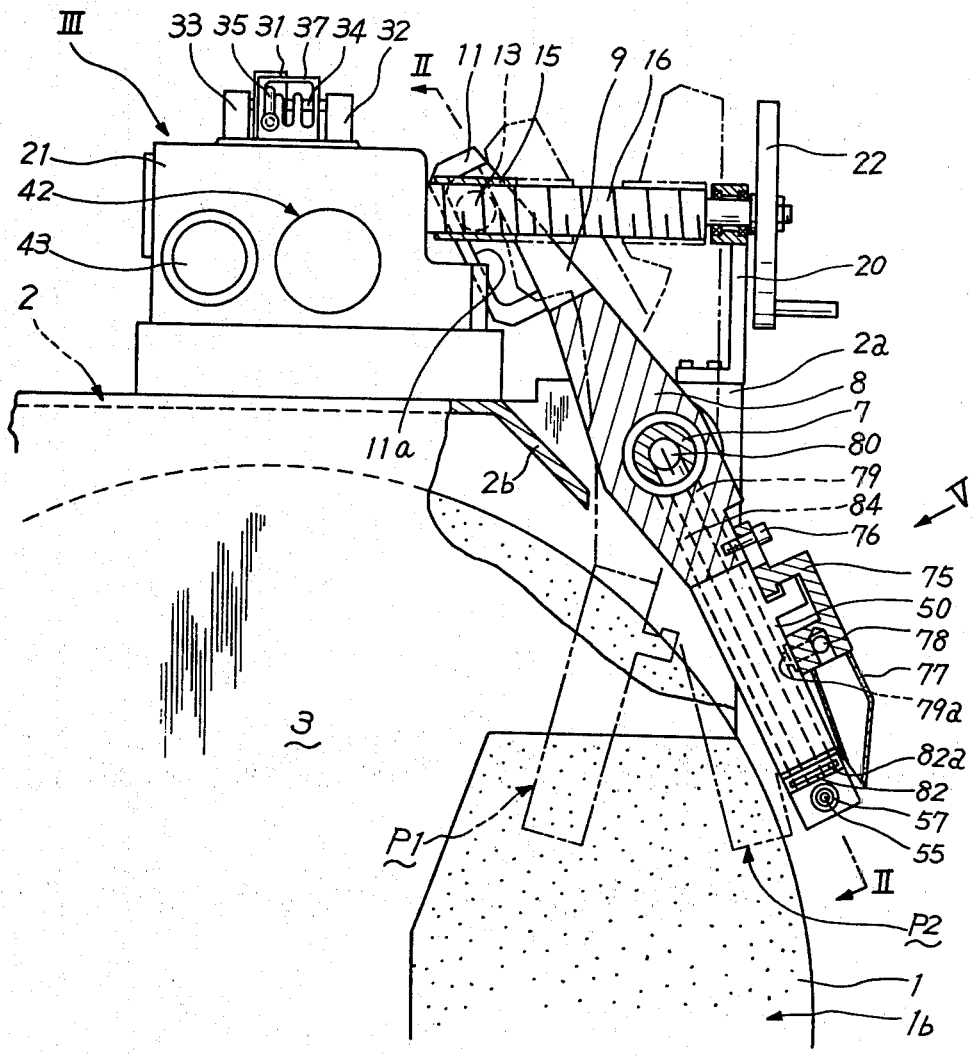
FIG. 1 is a side elevational view, partly in section, of a guard device provided with a side dressing apparatus according to the present invention.
Figure 2:
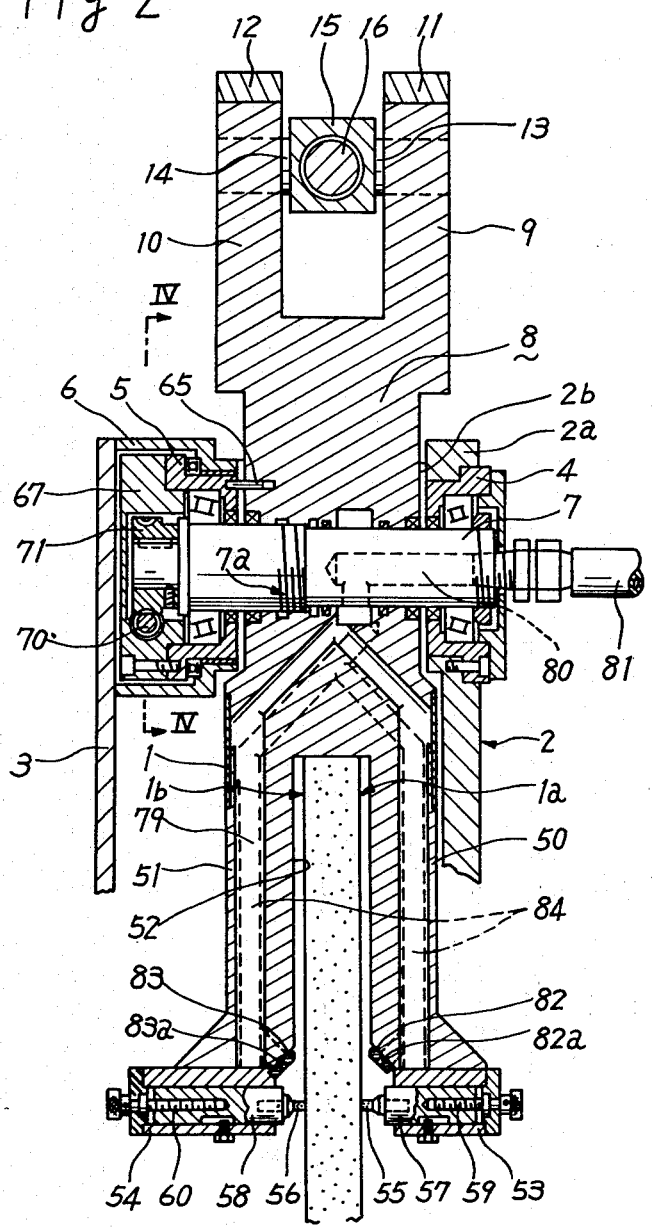
FIG. 2 is a sectional view taken along the line II—II in FIG. 1.

Referring now to the drawings, wherein like reference numerals or characters refer to identical or corresponding parts throughout the several views, and more particularly to FIGS. 1 and 2, there is shown a grinding wheel 1 which is rotatably mounted upon a wheel support, not shown. The wheel support also fixedly mounts thereon a guard body 2 for covering the upper, lower and rear portions and one side face 1*a* of the grinding wheel 1. A lateral guard plate 3 is pivotably mounted upon the guard body 2 through means of a hinge device, not shown, for covering the other side face 1*b* of the grinding wheel 1. A support member 4 is securedly inserted within the side wall 2*a* of the guard body 2 at the upper-front portion thereof. A support bracket 6, which rotatably supports a support member 5, is fixedly mounted on the forwardly sloped portion 2*b* of the guard body 2 at the upper-front portion thereof. A hinge shaft 7 is rotatably supported by the support members 4 and 5 in parallel relationship with the axis of the grinding wheel 1. A front cover member 8 for covering the upper-front portion of the grinding wheel 1 is rotatably and axially movably supported on the hinge shaft 7. The front cover member 8 is also threadedly engaged with the thread portion 7*a* of the hinge shaft 7.

Upon the upper end of the front cover member 8, there are provided a pair of guide members 9 and 10 forming a U-shaped configuration, as shown in FIG. 2, to which support members 11 and 12 are respectively securedly attached. Each of the support members 11 and 12 has a C-shaped configuration, as shown in FIG. 1, to define a guide 11*a* together with each of the guide members 9 and 10. A pair of guide pins 13 and 14 are slidably received within the guide 11*a* in parallel relationship with the hinge shaft 7. These guide pins 13 and 14 protrude in opposite directions from opposite sides of a nut member 15 which is interposed between the guide members 9 and 10 and is threadedly engaged with a screw shaft 16. The screw shaft 16 extends above the grinding wheel 1 in a direction perpendicular to the axis of the hinge shaft 7 within a vertical plane including the center line of the front cover member 8 and the grinding wheel 1.

Figure 3:
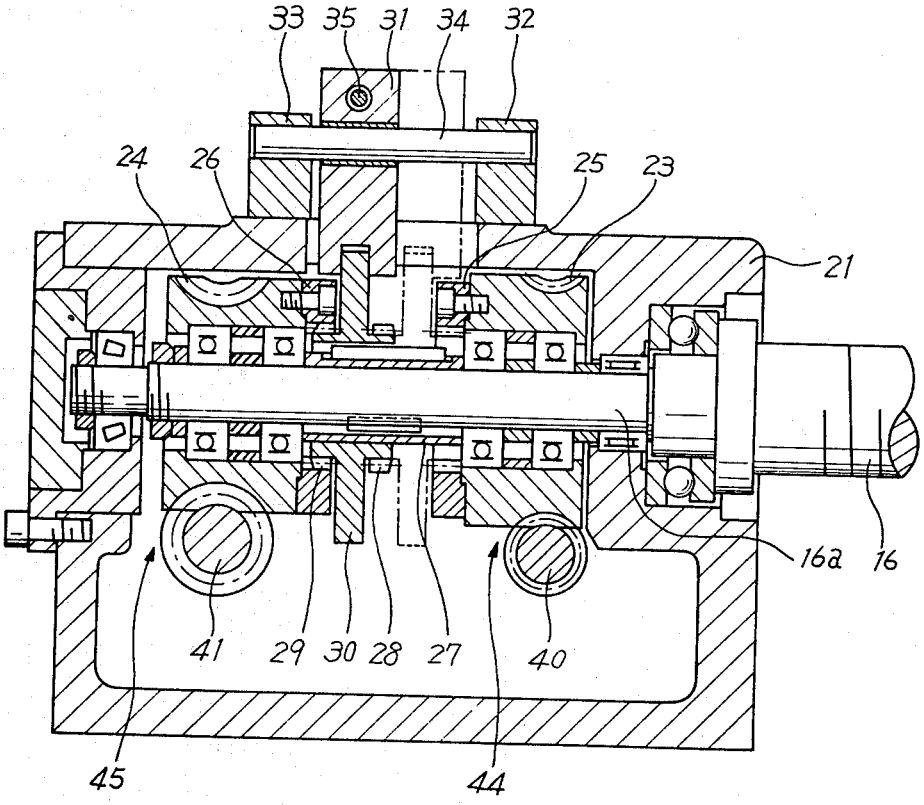
FIG. 3 is an enlarged sectional elevation view of component parts shown at III in FIG. 1.

The screw shaft 16 is slidably received at its one end in a support bracket 20 fixed upon the side wall 2*a* of the guard body 2 and the support bracket 6, and at its other end 16*a* in a housing 21 fixedly mounted upon the guard body 2. A handle wheel 22 is integrally connected to the one end of the screw shaft 16 outwardly of the support bracket 20 for manually rotating the screw shaft 16. As best shown in FIG. 3, a pair of axially spaced apart worm wheels 23 and 24 are rotatably mounted on the other end 16*a* of the screw shaft 16 within the housing 21. A pair of gear members 25 and 26, each being provided with an internal gear, are respectively secured to the worm wheels 23 and 24 in opposed relationship with each other. A spacing member 27 is keyed on the other end 16*a* of the screw shaft 16 between the worm wheels 23 and 24. A gear member 30 is slidably keyed on the spacing member 27 and provided with external gears 28 and 29 which are engageable with internal gears of the gear members 25 and 26, respectively. The flange portion formed between the external gears 28 and 29 of the gear member 30 is fitted into a slider member 31 which is rotatably and slidably supported on a guide bar 34. The guide bar 34 is carried by a pair of supporting blocks 32 and 33 mounted on the top surface of the housing 21. A shift lever 35 is secured to the slide member 31 through a guide plate 37 fixed on the housing 21, as shown in FIG. 1. The guide plate 37 is formed with three separate notches with which the shift lever 35 is shiftably engageable at a first position where the external gear 29 is engaged with the internal gear of the gear member 26, at a second position where no external gear 29 or 28 is engaged with the internal gear of the gear member 26 or 25, and at a third position where the external gear 28 is engaged with the internal gear of the gear member 25.

The worm wheels 23 and 24 are respectively engaged with worms 40 and 41 rotatably supported within the housing 21. The worms 40 and 41 are drivingly connected to a well-known ratchet type drive means 42 and a hydraulic motor 43, respectively, as shown in FIG. 1 to selectively rotate the screw shaft 16.

As shown in FIG. 2, the front cover member 8 is bifurcated at its lower end into a pair of leg portions 50 and 51 so as to define a space 52 therebetween to be receivable the grinding wheel 1 thereinto. The leg portions 50 and 51 have secured thereto dressing bodies 53 and 54 within which dressing holders 57 and 58 are slidably received for movement parallel to the axis of the grinding wheel 1, respectively. The dressing holders 57 and 58 are respectively provided with dressing tools 55 and 56 for dressing the side surfaces 1*a* and 1*b* of the grinding wheel 1. Adjustment screw shafts 59 and 60, which are rotatably supported within the dressing bodies 53 and 54, are screwed into the rear portions of the dressing holders 57 and 58 for adjustment of the dressing tools 55 and 56 relative to the grinding wheel 1, respectively.

Figure 4:
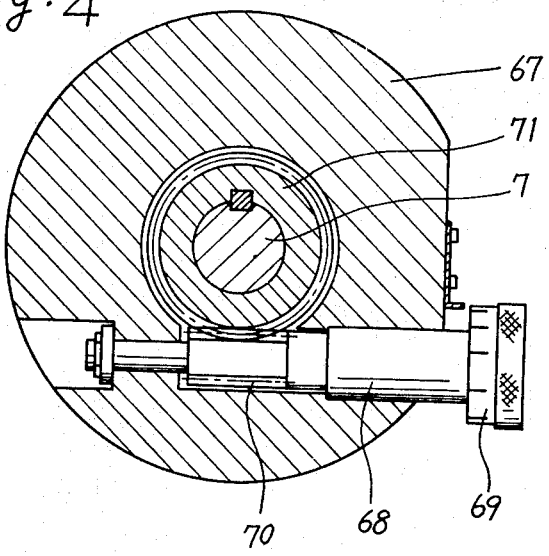
FIG. 4 is an enlarged sectional view taken along the line IV—IV in FIG. 2.

Still in FIG. 2, a restricting member 65 is press-fitted into the one side surface of the support member 5 and is axially slidably received in the side surface of the front cover member 8 in parallel relationship with the hinge shaft 7 so that the support member 5 and the front cover member 8 are bodily rotatable. Secured to the other side surface of the support member 5 is a housing block 67 within which a worm shaft 68 is rotatably received but restrained from axial movement in perpendicular relationship with the hinge shaft 7, as shown in FIG. 4. The worm shaft 68 is provided at its one end with an adjusting knob 69 outside the housing block 67, and at its other end with a worm 70 in meshing engagement with a worm wheel 71 secured to the end of the hinge shaft 7. Accordingly, manipulation of the adjusting knob 69 causes rotation of the hinge shaft 7 relative to the front cover member 8 to thereby move the front cover member 8 axially of the hinge shaft 7 through threaded connection therebetween to render an in-feed movement to the dressing tools 55 and 56.

Figure 5:
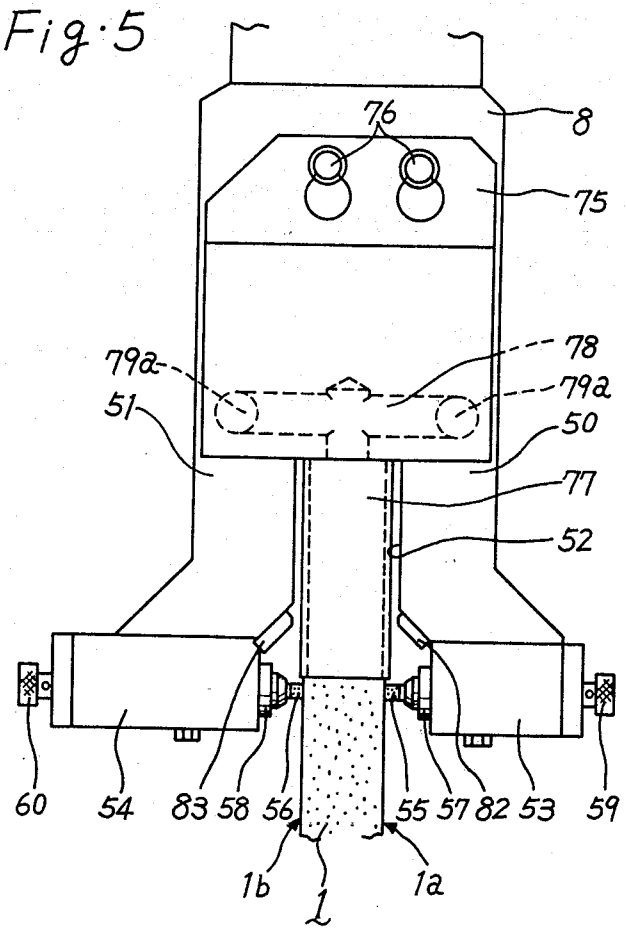
FIG. 5 is an enlarged view of a lower portion of the wheel front cover, as viewed in the direction of an arrow V in FIG. 1.

As shown in FIG. 5, a closing cover 75 is detachably mounted on the lower portion of the front cover member 8 by tightening bolts 76 for covering the front portion of the space 52 formed between the leg portions 50 and 51. The closing cover 75 has secured at its lower end a coolant nozzle member 77 for supplying coolant to the periphery of the grinding wheel 1. The coolant nozzle member 77 is fluidically communicated with a passage 78 formed within the closing cover 75. The passage 78 is, in turn, communicated with ports 79*a* connected to passages 79 formed within leg portions 50 and 51. The passages 79 are communicated with a supply passage 80 formed within the hinge shaft 7. The supply passage 80 is connected to a coolant supply source through a pipe 81. A pair of plates 82 and 83 are respectively secured to the leg portions 50 and 51 above the dressing bodies 53 and 54 are formed with ejection ports 82*a* and 83*a* for supplying coolant to both side surfaces 1*a* and 1*b* of the grinding wheel 1. The ejection ports 82*a* and 83*a* are connected to the supply passage 80 through passages 84 formed within leg portions 50 and 51.

The operation of the above-described construction will be now described.

Figure 6:
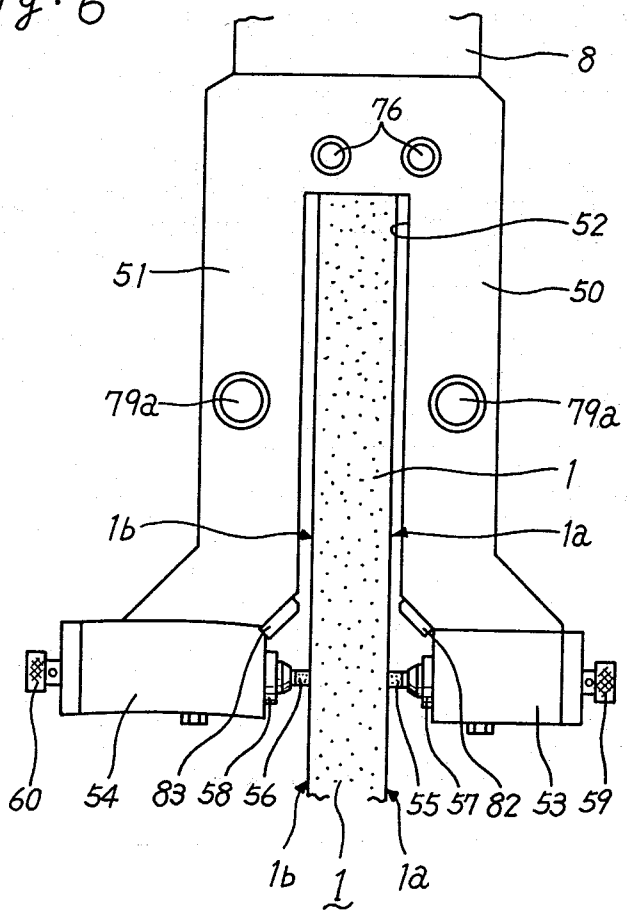
FIG. 6 is similar to FIG. 5 except for a closing cover being detached.

In order to dress the side surfaces 1*a* and 1*b* of the fresh grinding wheel 1 having been exchanged, the closing cover 75 is removed from the front cover member 8 by loosening the tightening bolts 76, as shown in FIG. 6, with the front cover member 8 being positioned at its original position shown in solid lines in FIG. 1. The ports 79*a* are covered by plugs. The shift lever 35 is then shifted to the left into its first position to engage the external gear 29 with the internal gear of the gear member 26. Subsequently, the hydraulic motor 43 is operated to rotate the screw shaft 16 through the worm 41, worm wheel 24, gear members 26 and 30, and the spacing member 27, so as to move the nut member 15 to the right, as viewed in FIG. 1. Accordingly, the front cover member 8 and the support member 5 are bodily rotated in a clockwise direction as viewed in FIG. 1 into a position P1 shown in phantom lines in FIG. 1.

The adjustment screw 59 is thereafter manipulated to move the dressing tool into engagement with the side surface 1*a* of the grinding wheel 1. The hydraulic motor 43 is then driven in a reverse direction to retract the front cover member 8 into its original position. The adjusting knob 69 is subsequently manipulated to rotate the hinge shaft 7 relative to the front cover member 8 through the worm 70 and the worm wheel 71, to thereby move the front cover member 8 to the left as viewed in FIG. 2 through the threaded engagement between the front cover member 8 and the hinge shaft 7 to render a predetermined in-feed movement to the dressing tool 55. Subsequently, the front cover member 8 is rotated in clockwise direction into the position P1 to dress the side surface 1*a* of the grinding wheel 1 by the dressing tool 55. After completion of the dressing operation on the side surface 1*a*, the front cover member 8 is returned to its original position. It is to be noted here that during the dressing operation, coolant fluid is supplied from the pipe 81 to the passage 84 to eject coolant fluid to the side surface 1*a* from the ejection port 82*a*. In this manner, a predetermined number of dressing operations are repeated on the side surface 1*a* of the grinding wheel 1, until the side surface 1*a* is dressed to a predetermined size.

After the side surface 1*a* of the grinding wheel 1 is dressed to the predetermined size, the width of the grinding wheel 1 is measured by a micrometer or the like by using the dressed side surface 1*a* as a reference surface to determine the number of dressing operations on the side surface 1*b* of the grinding wheel 1 required for a predetermined width of the grinding wheel 1. After measurement of the width of the grinding wheel 1, the adjustment screw 60 is manipulated to move the dressing tool 56 into contact with the side surface 1*b* of the grinding wheel 1 with the front cover member 8 being at its position P1. The adjusting knob 69 is also manipulated to move the front cover member 8 to the right to render an in-feed movement to the dressing tool 56 with the front cover member 8 being at its original position. The hydraulic motor 43 is operated to perform a dressing operation on the side surface 1*b* of the grinding wheel 1, until the width of the grinding wheel 1 becomes a predetermined value. It is to be noted that a final in-feed amount of the dressing tool 56 is determined by re-measuring the width of the grinding wheel 1 by the micrometer.

After dressing operations on both side surfaces 1*a* and 1*b* of the grinding wheel 1 are completed, the tool holders 57 and 58 are moved away from the grinding wheel 1 to return the dressing tools 55 and 56 to their original positions. The plugs fitted into the ports 79*a* are removed and the closing cover 75 is fixedly secured on the front cover member 8 by clamping the tightening bolts 76. Subsequently, the shift lever 35 is shifted to the right into its second position to disengage the external gear 29 from the gear member 26 and the handle wheel 22 is operated to rotate the front cover member 8 in a position P2 in FIG. 1 where the coolant nozzle member 77 is faced with the periphery of the grinding wheel 1. The shift lever 35 is thereafter shifted further to the right into its third position to engage the external gear 28 with the gear member 25.

After the above-mentioned operations, the coolant fluid is supplied from nozzle member 77 and the ejection ports 82*a* and 83*a* to the periphery and the side surfaces of the grinding wheel 1 and the grinding operation is performed by the grinding wheel 1 on a workpiece, not shown. When the grinding wheel 1 is decreased in its diameter in accordance with repeated grinding operations, the ratchet type drive means 42 is operated to rotate the front cover member 8 a predetermined amount in clockwise direction through the worm 40, worm wheel 23, gear members 25 and 28, the spacing member 27 and the screw shaft 16 so as to face the coolant nozzle member 77 with the periphery of the decreased grinding wheel 1.

Obviously, numerous modifications and variations of the present invention are possible in light of the above teachings. It is to be understood, therefore, that within the scope of the appended claims, the invention may be practiced otherwise than as specifically described herein.

What is claimed is:

1. A guard device for a grinding wheel in a grinding machine comprising:

a guard body for covering said grinding wheel;

a front cover member pivotably mounted upon said guard body for covering the upper-front portion of said grinding wheel;

a hinge shaft carried in a direction parallel to the axis of said grinding wheel for pivotably supporting said front cover member;

a screw shaft rotatably supported upon said guard body above said hinge shaft in a direction perpendicular to the axis of said hinge shaft;

a nut member threadedly engaged with said screw shaft for pivotably moving said front cover member through the axial movement thereof caused by the rotation of said screw shaft;

means mounted upon said guard body for rotating said screw shaft;

a pair of leg portions extended from the lower end of said front cover member to be receivable said grinding wheel within a space formed therebetween;

a closing cover detachably secured to said front cover member for covering the space formed between said pair of leg portions; and a pair of dressing tools respectively mounted upon said pair of leg portions for dressing side surfaces of said grinding wheel.

2. A guard device as claimed in claim 1, wherein said front cover member and said hinge shaft are in threaded engagement, and further comprising means for rotating said hinge shaft relative to said front cover member to move said front cover member axially of said hinge shaft, to thereby render an in-feed movement to each of said dressing tools.

3. A guard device as claimed in claim 2, wherein said means for rotating said hinge shaft comprises:

a housing block rotatably mounted upon said hinge shaft, but restrained from rotation relative to said front cover member;

a rotary shaft rotatably received in said housing block;

an adjusting knob connected to said rotary shaft and extending outwardly of said housing block;

a worm formed on said rotary shaft; and a worm wheel mounted on said hinge shaft, whereby an in-feed movement can be rendered to each of said dressing tools by manipulating said adjusting knob.

4. A guard device as claimed in claim 1, wherein said pair of dressing tools comprises:

a pair of dressing bodies respectively secured to said pair of leg portions;

a pair of dressing holders respectively slidably received for movement parallel to the axis of said grinding wheel and carrying said dressing tools;

a pair of adjustment screw shafts respectively rotatably supported by said dressing bodies and screwed into said dressing holders for adjustment of said dressing tools relative to said grinding wheel.

5. A guard device as claimed in claim 1, wherein said means for rotating said screw shaft comprises:

a manually operated handle wheel secured to one end of said screw shaft;

a worm wheel rotatably mounted upon the other end of said screw shaft;

a worm engaged with said worm wheel;

a hydraulic motor for rotating said worm; and means for selectively transmitting rotational movement of said worm wheel to said screw shaft.

6. A guard device as claimed in claim 5, wherein said transmitting means comprises:

a first gear member secured to said worm wheel and having an internal gear;

a second gear member keyed on said screw shaft and having an external gear engageable with said internal gear; and a shift lever connected to said second gear member for selectively engaging said external gear with said internal gear.

7. A guard device as claimed in claim 1, wherein said closing cover has secured thereto a coolant nozzle member for supplying coolant fluid to the periphery of said grinding wheel in a grinding operation on a workpiece to be ground.

8. A guard device as claimed in claim 7, wherein said pair of leg portions are respectively provided with ejection ports for supplying coolant fluid to the side surfaces of said grinding wheel.

* * * * *